US008262168B2

(12) United States Patent
Hall et al.

(10) Patent No.: US 8,262,168 B2
(45) Date of Patent: Sep. 11, 2012

(54) MULTIPLE MILLING DRUMS SECURED TO THE UNDERSIDE OF A SINGLE MILLING MACHINE

(76) Inventors: David R. Hall, Provo, UT (US); Thomas Morris, Spanish Fork, UT (US)

( * ) Notice: Subject to any disclaimer, the term of this patent is extended or adjusted under 35 U.S.C. 154(b) by 0 days.

(21) Appl. No.: 12/888,200

(22) Filed: Sep. 22, 2010

(65) Prior Publication Data

US 2012/0068524 A1 Mar. 22, 2012

(51) Int. Cl.
*E01C 23/09* (2006.01)

(52) U.S. Cl. ..... 299/39.5; 404/90

(58) Field of Classification Search ..... 299/39.4, 299/81.1, 81.2, 85.1, 39.5; 404/90, 91, 94
See application file for complete search history.

(56) References Cited

U.S. PATENT DOCUMENTS 1,898,158 A 2/1933 Winkle
2,039,078 A 4/1936 Hertwig
1,887,341 A 11/1936 Venable
2,098,895 A 11/1937 Velten
2,124,438 A 7/1938 Struk
2,633,782 A 4/1953 Clement
2,893,299 A 7/1959 Moir
2,908,206 A 10/1959 Melanson
2,938,438 A 5/1960 Hamilton
3,075,436 A 1/1963 McRae
3,254,392 A 6/1966 Novkov
3,361,042 A 1/1968 Cutler
3,409,330 A * 11/1968 Hatcher et al. ..... 299/39.4
3,732,023 A 5/1973 Rank
3,746,396 A 7/1973 Radd
3,817,644 A 6/1974 Matson
3,830,321 A 8/1974 McKenry
3,970,404 A 7/1976 Benedetti
3,989,401 A 11/1976 Moench
4,018,540 A 4/1977 Jackson
4,098,362 A 7/1978 Bonnice
4,104,736 A 8/1978 Mendenhall
4,109,737 A 8/1978 Bovenkerk
4,124,325 A 11/1978 Cutler
4,127,351 A 11/1978 Vural
4,139,318 A 2/1979 Jakob
4,156,329 A 5/1979 Daniels
4,172,616 A 10/1979 Delli-Gatti, Jr.
4,172,679 A 10/1979 Wirtgen
4,175,886 A 11/1979 Moench
4,195,946 A 4/1980 Swisher
4,199,035 A 4/1980 Thompson
4,201,421 A 5/1980 Den Besten
4,215,949 A 8/1980 Gabriel, Jr.
4,261,669 A 4/1981 Edo
4,268,089 A 5/1981 Spence
4,313,690 A 2/1982 Hojbjerg
4,335,975 A 6/1982 Schoelkopf
4,347,016 A 8/1982 Sindelar et al.
4,407,605 A 10/1983 Wirtgen
4,439,250 A 3/1984 Acharya
(Continued)

*Primary Examiner* — John Kreck
(74) *Attorney, Agent, or Firm* — Philip W. Townsend, III

(57) ABSTRACT

In one aspect of the present invention, a motorized vehicle comprises a vehicle frame. The vehicle frame comprises translatable elements. The frame comprises a forward end and a rearward end. The invention comprises of a first rotary degradation drum that is connected to the underside of the frame. The invention comprises of at least a second rotary degradation drum also connected to the underside of the frame and rearward of the first rotary degradation drum.

19 Claims, 10 Drawing Sheets

U.S. PATENT DOCUMENTS 4,473,320 A 9/1984 Register
4,484,783 A 11/1984 Emmerich
4,534,674 A 8/1985 Cutler
4,594,022 A 6/1986 Jeppson
4,668,017 A 5/1987 Petersen
4,676,689 A 6/1987 Yant
4,684,176 A 8/1987 Den Besten
4,692,350 A 9/1987 Clarke
4,720,207 A * 1/1988 Salani ..... 404/90
4,725,098 A 2/1988 Beach
4,728,153 A 3/1988 Ojanen
4,776,862 A 10/1988 Wiand
4,784,518 A 11/1988 Cutler
4,793,730 A 12/1988 Butch
4,827,559 A 5/1989 Norland
4,836,614 A 6/1989 Ojanen
4,850,649 A 7/1989 Beach et al.
4,880,154 A 11/1989 Tank
4,921,310 A 5/1990 Hedlund
4,932,723 A 6/1990 Mills
4,940,288 A 7/1990 Stiffler
4,944,559 A 7/1990 Sionnet et al.
4,951,762 A 8/1990 Lundell
4,968,101 A 11/1990 Bossow
5,007,685 A 4/1991 Beach
5,026,205 A 6/1991 Gorski
5,074,063 A 12/1991 Vannette
5,078,540 A 1/1992 Jakob et al.
5,112,165 A 5/1992 Hedlund
5,131,788 A 7/1992 Hulicsko
5,141,289 A 8/1992 Stiffler
5,186,892 A 2/1993 Pope
5,219,380 A 6/1993 Young
5,251,964 A 10/1993 Ojanen
5,303,984 A 4/1994 Ojanen
5,366,320 A 11/1994 Hanlon
5,382,084 A 1/1995 Diver
5,392,540 A 2/1995 Cooper
5,415,462 A 5/1995 Massa
RE35,088 E 11/1995 Gilbert
5,490,339 A 2/1996 Accettola
5,503,463 A 4/1996 Ojanen
5,505,598 A 4/1996 Murray
5,556,225 A 9/1996 Marino
5,720,528 A 2/1998 Ritchey
5,722,789 A * 3/1998 Murray et al. ..... 299/39.4
5,725,283 A 3/1998 O'Neill
5,730,502 A 3/1998 Montgomery
5,738,698 A 4/1998 Kapoor
5,765,926 A 6/1998 Knapp
5,791,814 A 8/1998 Wiley
5,794,854 A 8/1998 Yie
5,823,632 A 10/1998 Burkett
5,837,071 A 11/1998 Andersson
5,884,979 A 3/1999 Latham
5,934,542 A 8/1999 Nakamura
5,935,718 A 8/1999 Demo
5,944,129 A 8/1999 Jensen
5,947,636 A 9/1999 Mara
5,947,638 A 9/1999 Heims
5,951,561 A 9/1999 Pepper
6,051,079 A 4/2000 Andersson
6,065,552 A 5/2000 Scott
6,113,195 A 9/2000 Mercier
6,122,601 A 9/2000 Swanson
6,158,920 A 12/2000 Malot
6,193,770 B1 2/2001 Sung
6,196,636 B1 3/2001 Mills
6,199,956 B1 3/2001 Kammerer
6,287,048 B1 9/2001 Hollon
6,341,823 B1 1/2002 Sollami
6,357,832 B1 3/2002 Sollami
6,371,689 B1 4/2002 Wiley
6,416,249 B1 * 7/2002 Crupi ..... 404/91
6,457,267 B1 10/2002 Porter
6,478,383 B1 11/2002 Ojanen
6,481,803 B2 11/2002 Ritchey
6,508,516 B1 1/2003 Kammerer
6,543,963 B2 4/2003 Bruso
6,551,018 B2 4/2003 Baker
6,577,141 B2 6/2003 Gandrud
6,623,207 B2 9/2003 Grubba
6,626,500 B1 * 9/2003 Cribb et al. ..... 299/78
6,644,755 B1 11/2003 Kammerer
6,692,083 B2 2/2004 Latham
6,702,393 B2 3/2004 Mercier
6,733,086 B1 5/2004 McSharry
6,769,836 B2 8/2004 Lloyd
6,779,948 B2 8/2004 Bruso
6,786,557 B2 9/2004 Montgomery, Jr.
6,799,922 B2 10/2004 Smith
6,824,225 B2 11/2004 Stiffler
6,846,354 B2 1/2005 Larsen
6,851,758 B2 2/2005 Beach
6,854,201 B1 2/2005 Hunter
6,854,810 B2 2/2005 Montgomery, Jr.
6,861,137 B2 3/2005 Griffin
6,889,890 B2 5/2005 Yamazaki
6,962,395 B2 11/2005 Mouthaan
7,150,131 B2 12/2006 Barker
7,179,018 B2 2/2007 Hall
7,223,049 B2 5/2007 Hall
7,287,818 B1 10/2007 Hall
7,387,345 B2 6/2008 Hall
7,387,464 B2 6/2008 Hall
7,387,465 B2 6/2008 Hall
7,396,085 B2 7/2008 Hall
7,413,375 B2 8/2008 Hall
7,473,052 B2 1/2009 Hall
7,544,011 B2 6/2009 Hall
7,549,821 B2 6/2009 Hall
7,585,128 B2 9/2009 Hall
7,591,607 B2 9/2009 Hall
7,591,608 B2 9/2009 Hall
7,641,418 B2 1/2010 Hall
7,712,996 B2 5/2010 Hall
2002/0070602 A1 6/2002 Sollami
2002/0074851 A1 6/2002 Montgomery
2002/0153175 A1 10/2002 Ojanen
2002/0175555 A1 11/2002 Mercier
2003/0137185 A1 7/2003 Sollami
2003/0141350 A1 7/2003 Noro
2003/0141753 A1 7/2003 Peay
2003/0230926 A1 12/2003 Mondy
2003/0234280 A1 12/2003 Cadden
2004/0026983 A1 2/2004 McAlvain
2004/0060797 A1 * 4/2004 Oseguera ..... 198/300
2005/0159840 A1 7/2005 Lin
2005/0173966 A1 8/2005 Mouthaan
2006/0125306 A1 6/2006 Sollami
2006/0198697 A1 * 9/2006 Hall et al. ..... 404/75
2006/0204331 A1 * 9/2006 Hall et al. ..... 404/75
2008/0129103 A1 * 6/2008 Hall et al. ..... 299/39.2
2008/0193214 A1 * 8/2008 Hall et al. ..... 404/75
2008/0284235 A1 11/2008 Hall
2009/0052987 A1 * 2/2009 Hall et al. ..... 404/90

* cited by examiner

MULTIPLE MILLING DRUMS SECURED TO THE UNDERSIDE OF A SINGLE MILLING MACHINE

BACKGROUND OF THE INVENTION

The present invention relates generally to degradation machines, generally the type used to mill road structures. Degradation machines typically comprise a frame structure, with a rotary degradation drum. The drum generally has a plurality of picks that come into contact with the road surface and degrade the structure.

U.S. Pat. No. 5,505,598 to Murray, which is herein incorporated for all that it contains, discloses a modification of a cold milling machine used to remove concrete and asphalt from an existing highway, including a milling drum segmented into two or more sections with the drive train for the milling drums passing through the core of the milling drum and supported via a journal or bearing to the outside of the machine. One or more sections of a milling drum may be added to the drum to vary its length. The sections of the milling drum can be added by bolting segments of the drum onto a driven sleeve which telescopes over the drive shaft of the machine. The segments of the milling drum can be readily removed by loosening a few bolts and removing the segments without having to slide a milling drum segment off of either end of a drive shaft. A segmented moldboard is also disclosed which allows the moldboard to be adjusted in segments, depending upon the cutting width of the milling drum of the machine. The segmented moldboards can be bolted together and are hydraulically operated between an operating position and a docking position. The hydraulic structure of the moldboards also allows the segments of the moldboard to float on the surface of the road or highway at a height depending upon whether or not the moldboard is following a portion of the highway that has been cut or a portion of the highway that is undisturbed.

U.S. Pat. No. 4,793,730 to Butch, which is herein incorporated for all that it contains, discloses a method and apparatus for renewing the surface of asphaltic paving at low cost for immediate reuse. The asphalt surface is heated to about 300°-500° F. The surface is broken to a depth of about two inches and the lower material thoroughly mixed in situ with the broken surface material. After mixing, the material is further heated to fuse the heated mixture into a homogeneous surface. The surface is screeded for leveling and compacted by a road roller. A road machine is disclosed having a steam manifold for heating the asphalt, transversely reciprocating breaker bars having teeth adjusted to the depth desired, toothed mixing cylinders for mixing the broken material, and a second steam manifold for reheating the mixed material. Reciprocating screed bars on the road machine level the mixed and heated material. Final compacting may be done with a conventional road roller.

BRIEF SUMMARY OF THE INVENTION

In one aspect of the present invention, a motorized vehicle comprises a vehicle frame. The vehicle frame comprises translatable elements. The vehicle frame comprises a forward end and a rearward end. The vehicle frame comprises of a first rotary degradation drum that is connected to the underside of the frame. The invention comprises at least a second rotary degradation drum also connected to the underside of the frame and rearward of the first rotary degradation drum.

The first and/or second rotary degradation drum may be configured to move laterally with respect to a length of the frame. The first and second rotary degradation drums may be configured to degrade a formation at different depths. The first and second rotary degradation drums may expand outwards such that collectively they mill a path wider than the milling machine. The rotary assembly may be a rotary degradation drum with a plurality of cutting elements. The plurality of cutting elements may be enhanced with polycrystalline diamond. The first or second degradation zone may occur in a direction of travel about the rotary axis that may be perpendicular to the underside of the vehicle. The first and second rotary degradation drums may be configured to degrade a formation into aggregate. The rotary degradation drum may be in communication with an actuating mechanism adapted to move the rotary degradation drum in a horizontal, vertical, transverse, diagonal, and pivotal direction relative to the motorized vehicle. The rotary degradation drum may be configured to translate through a hydraulic mechanism. The first and second rotary degradation drums may be configured to translate laterally along a track attached to the underside. The rotary degradation drums may be configured to operate simultaneously.

Each rotary degradation drum may have a conveyor belt. The rotary degradation drums may share a conveyor belt. A conveyor belt may be encased by a chute with open ends. The conveyor belt may remove aggregate from the machine. Liquid jets may remove aggregate from the rotary degradation drums.

The first and second rotary degradation drums may be encased in separate milling chambers. The first and second rotary degradation drums may be encased in the same milling chamber. The milling chambers may be expandable.

The second rotary degradation drum may be a split drum with a single axle. The second split drum may comprise portions that are configured to extend beyond a side of the motorized vehicle. The second rotary degradation drum may be positioned laterally to a third independent rotary degradation drum.

DETAILED DESCRIPTION OF THE INVENTION AND THE PREFERRED EMBODIMENT

Figure 1:
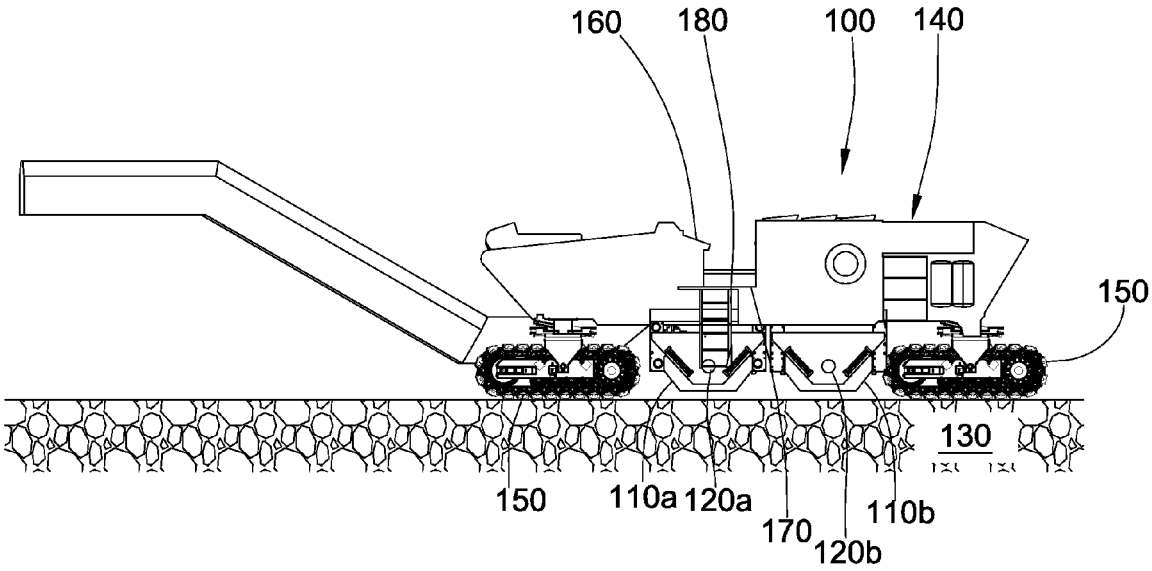
FIG. 1 is an orthogonal diagram of an embodiment of a milling machine.

FIG. 1 discloses an embodiment of a milling machine 100. The milling machine 100 has a forward end and a rearward end. Two milling chambers 110*a*, 110*b* are located along the underside of the vehicle frame. Each of the milling chambers 110*a*, 110*b* encases one of rotary degradation drums 120*a*, 120*b* attached to the underside of the frame. Some embodiments may include a single milling chamber that encases all of the rotary degradation drums. One of the rotary degradation drums 120*a*, 120*b* is forward the other. Once the vehicle 100 is in motion the rotary degradation drums 120*a*, 120*b* are lowered and come into contact with a formation 130. The rotary degradation drums 120*a*, 120*b* may comprise of a plurality of picks that degrade the formation 130 into aggregate. In other embodiments, the machine 100 may comprise more than two drums.

A ladder 180 in the center of the milling machine 100 allows access to the controls 160. The controls 160 are located in the center of the milling machine 100. The controls 160 are operated from the platform 170 at the top of the ladder 180. The rearward end of the milling machine 100 comprises a diesel engine 140. The engine 140 provides the power necessary to rotate the rotary degradation drums 120. Additionally, tread 150 is located on the underside of the vehicle 100. The tread 150 is used to transport the milling machine 100.

Figure 2:
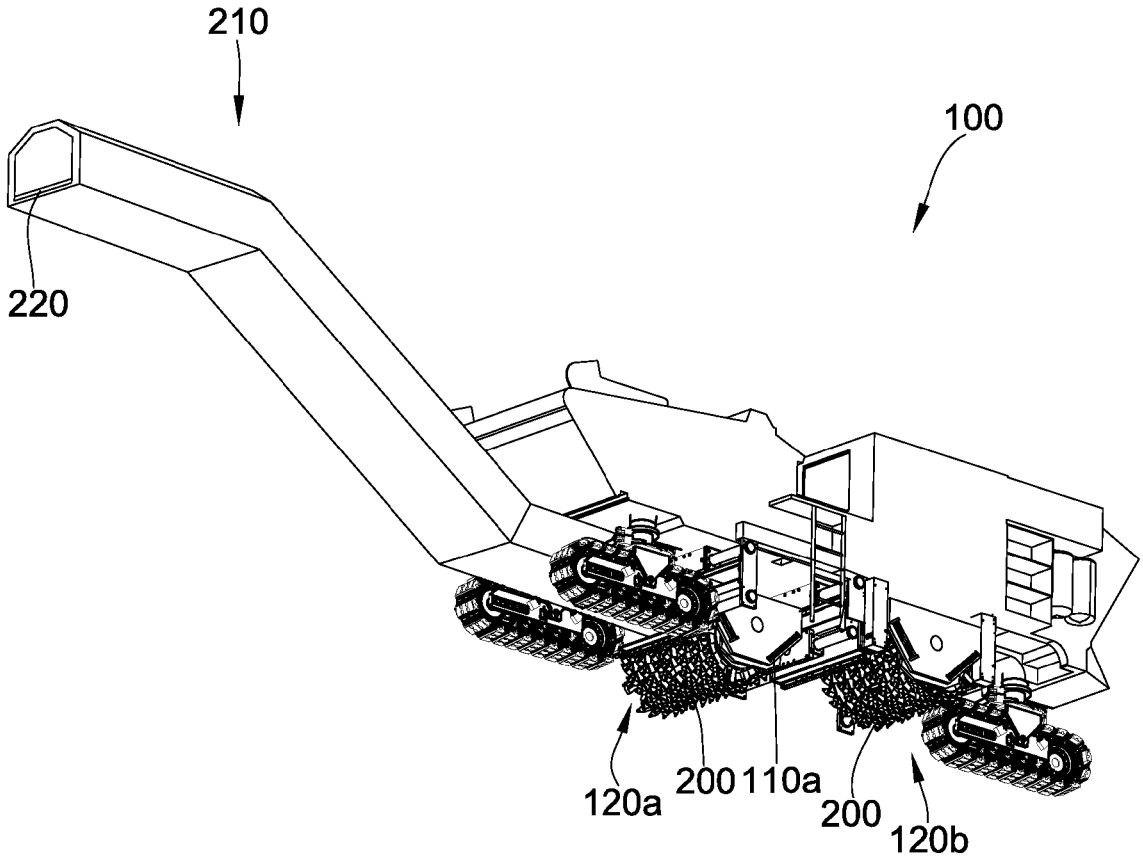
FIG. 2 is a perspective diagram of an embodiment of a milling machine.

FIG. 2 discloses another embodiment of the milling machine 100. Two rotary degradation drums 120*a*, 120*b* are on the underside of the milling machine 100. Each of the rotary degradation drums 120*a*, 120*b* comprises of a plurality of cutting elements 200. The cutting elements 200 comprise of a variety of picks that may be enhanced with polycrystalline diamond.

A chute 210 with open ends is located on the forward end of the milling machine 100. The chute 210 encases a conveyor belt 220. The conveyor belt 220 enters each of the milling chambers 110*a*, 110*b*. Aggregate is deposited onto the conveyor belt 220 during the degradation process. The conveyor belt 220 transports the aggregate out of the chute 210 and into a disposal container.

Figure 3:
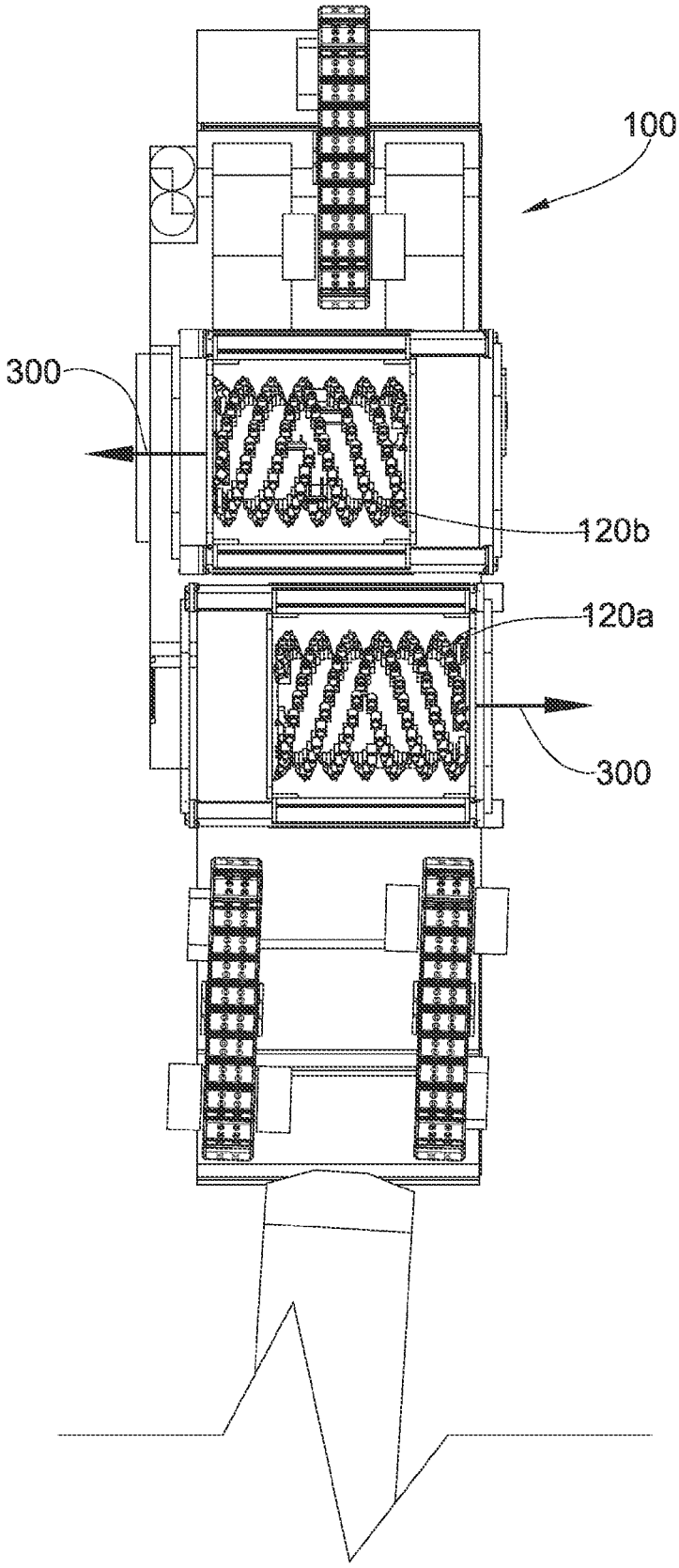
FIG. 3 is an orthogonal diagram of an embodiment of a milling machine.

FIG. 3 discloses an embodiment of the underside of the milling machine 100. In this embodiment, two separate rotary degradation drums 120*a*, 120*b* are depicted; a forward rotary degradation drum and a rearward rotary degradation drum. Either a hydraulic cylinder mechanism or a sliding track mechanism on the underside of the milling machine 100 may be configured to translate the rotary degradation drums 120*a*, 120*b* in a horizontal or transverse direction. Each of the rotary degradation drums 120*a*, 120*b* may translate outward in the direction of the arrows 300 as indicated in the figure. This allows a cut from a single pass to extend beyond the width of the milling machine 100.

Figure 4:
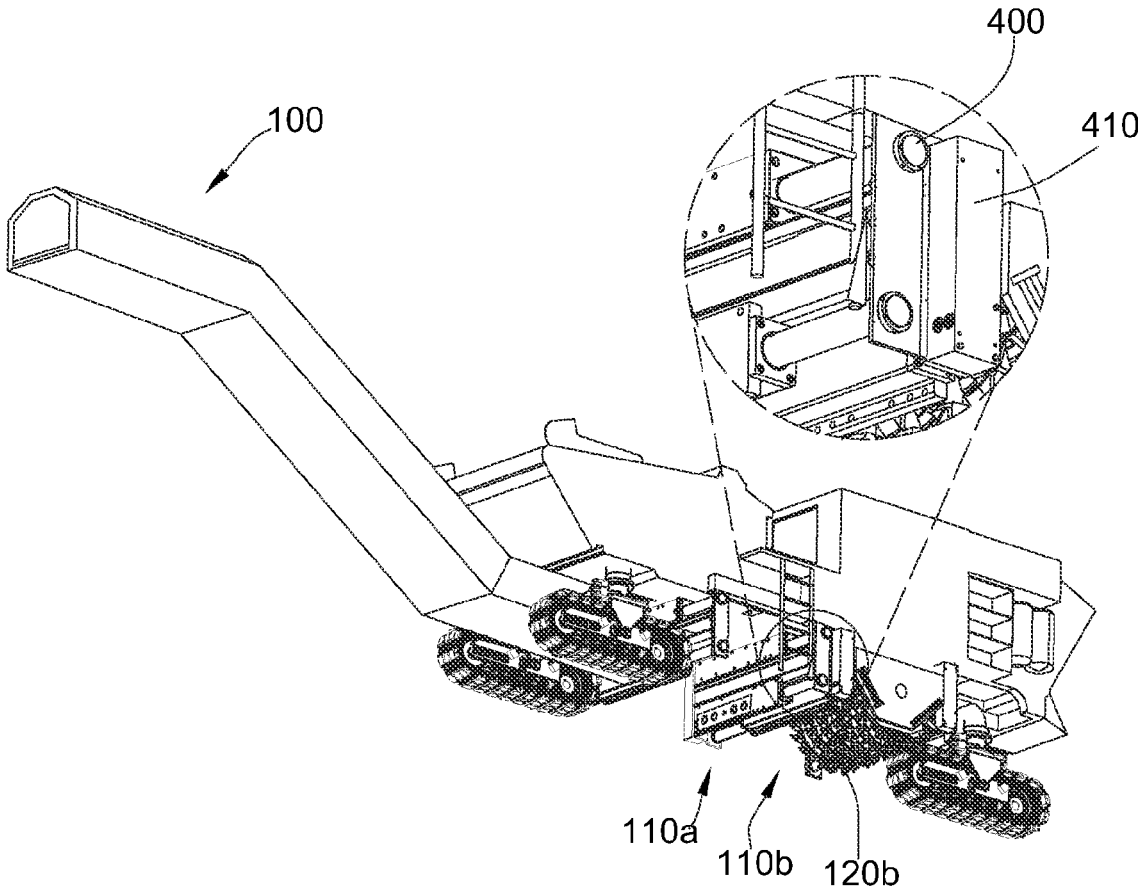
FIG. 4 is a perspective diagram of an embodiment of a milling machine.

FIG. 4 discloses another embodiment of the milling machine 100. Two milling chambers 110*a*, 110*b* are attached to the underside of the machine. Forward rotary degradation drum 120*a* has been omitted to show the detail of hydraulic cylinder mechanisms 400. The hydraulic cylinder mechanisms 400 in combination with hydraulic ram mechanisms 410 may be adapted to move the rotary degradation drums 120*a*, 120*b* in a horizontal, vertical, transverse, diagonal, and pivotal direction relative to the milling machine 100. The rotary degradation drums 120*a*, 120*b* are propelled in and out by the hydraulic cylinder mechanisms 400 and up and down by the hydraulic ram mechanisms 410 depending on the desired position and function of the rotary degradation drums 120*a*, 120*b*. The milling chambers 110*a*, 110*b* expand and contract in and out to allow the necessary translation of the rotary degradation drums 120*a*, 120*b* and hydraulic cylinder mechanisms 400. In some embodiments, all of the expanding and contracting of the milling machine 100 is done mechanically and does not require manual labor by an operator.

Figure 5A:
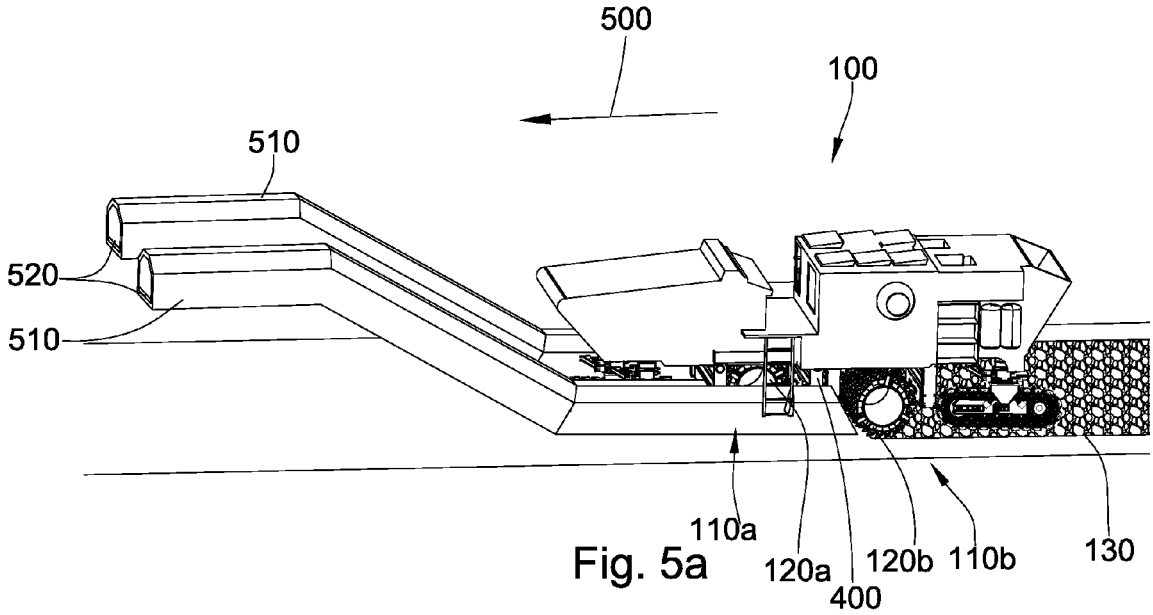
FIG. 5*a* is a perspective diagram of an embodiment of a milling machine.

FIG. 5*a* discloses another embodiment of the milling machine 100. The milling machine 100 travels in the direction of the arrow 500 as indicated in the figure. Two rotary degradation drums 120*a*, 120*b* are attached to the underside of the machine 100. The two rotary degradation drums 120*a*, 120*b* degrade the formation 130 at the same level of depth. However, each of the rotary degradation drums 120*a*, 120*b* is offset laterally away from the other. Hydraulic cylinder mechanisms 400 facilitate this lateral translation. The offset rotary degradation drums 120*a*, 120*b* allow a single pass to extend further than the width of the milling machine 100.

Additionally, two conveyor belts 520 are each encased in open ended chutes 510. The chutes 510 are connected to the forward end of the milling machine 100. Each of the conveyor belts 520 enters into one of the respective milling chambers 110*a*, 110*b* to collect aggregate and transport it away from the milling machine 100. Two separate conveyor belts 520 may help prevent blockages and buildups during the operation of the milling machine 100.

Figure 5B:
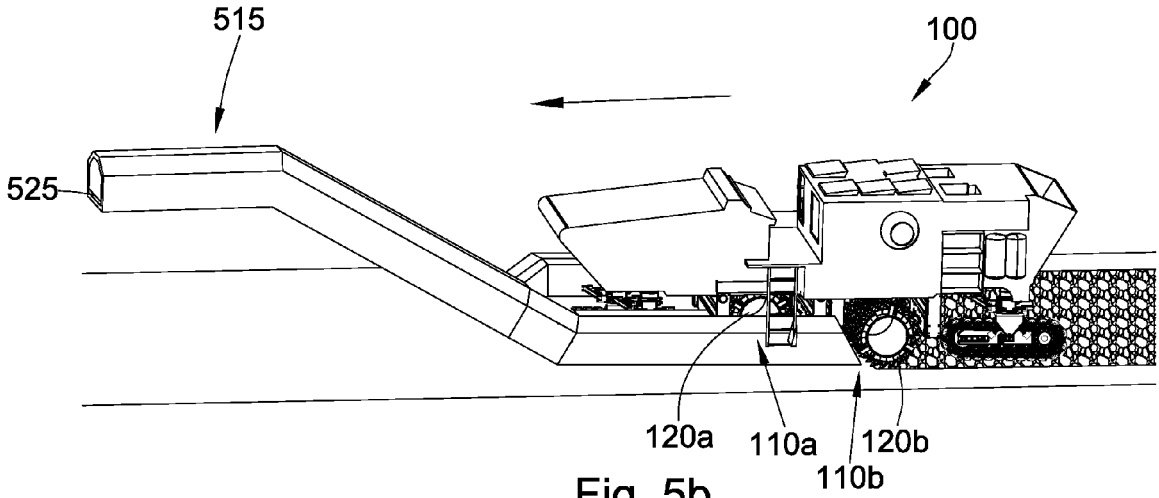
FIG. 5*b* is a perspective diagram of an embodiment of a milling machine.

FIG. 5*b* discloses another embodiment of the milling machine 100. The two rotary degradation drums 120*a*, 120*b* are laterally offset to mill a width greater than that of the milling machine 100. A conveyor belt 525 is encased in an open ended chute 515 and is located at the forward end of the milling machine 100. As the conveyor belt 525 approaches the milling chambers 110*a*, 110*b*, it diverges into two separate conveyor belts. Each milling chamber 210 receives an individual route that leads into the main conveyor belt.

Figure 6:
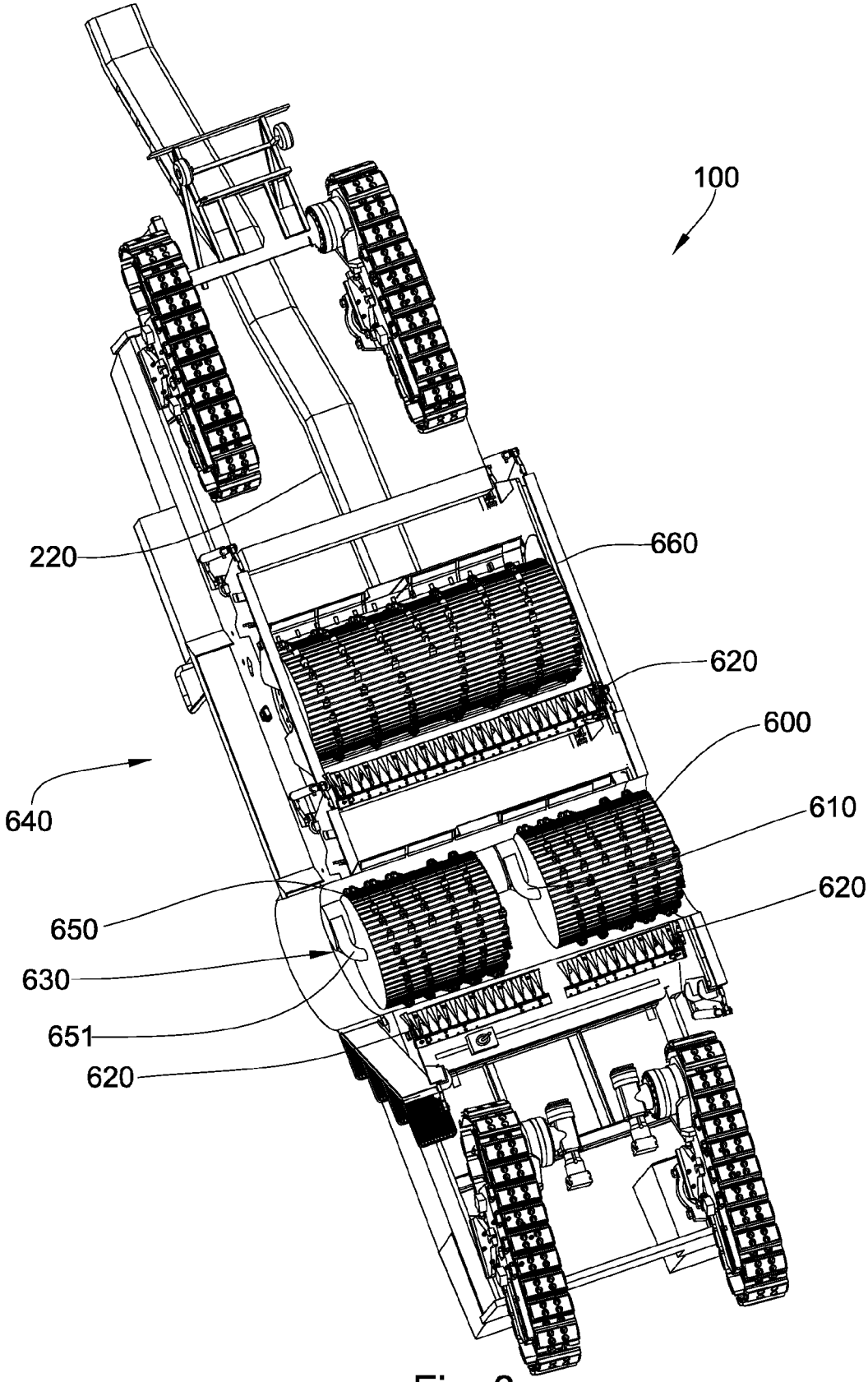
FIG. 6 is a perspective diagram of an embodiment of a milling machine.

FIG. 6 discloses another embodiment of the underside of the milling machine 100. Two rotary degradation drums 600, 650 are rearward of the milling drum 110. The two rearward rotary degradation drums 600, 650 are on separate axles 610, 651. The rearward rotary degradation drums 600, 650 may translate laterally outwards away from the other. The cut of the combined drums 660, 600, 650 may comprise a width greater than that of the milling machine 100. Translation of the rotary degradation drums 600, 651 may occur mechanically or manually.

Each of the drums 660, 600, 650 operate independently of the other and as such each drum may be used separately, such as in applications that require a narrow cut. In other embodiments, either drum 600 or 650 may be used in combination with drum 660. Thus, the drums may be mixed and matched to suit the particular application at hand.

In some embodiments, drums 600 or 650 may serve as spares for the milling machine 100. Thus, if drum 660 is damaged, or excessively worn, drums 600 and/or 650 may be utilized without requiring down time for the milling machine 100. In such cases, the worn out rotary degradation drum 660 may be raised up to avoid contact with the formation 130, and drums 600 and/or 650 may be lowered to come into contact with the formation 130.

Since drum 660 is substantially stationary in the embodiment disclosed in FIG. 6, a substantially permanent conveyor is in position forward of the drums. Conveyors for drums 600 and 650 may be attached manually to the machine once the drums 600, 650 are extended.

Liquid jets 620 may be in position rearward of each degradation drums 660, 600, 650 to remove excess aggregate from the milling chamber. Jets that may be compatible with the present invention are disclosed in U.S. Pat. No. 7,458,645, which is herein incorporated by reference for all that it discloses. The force of the jets 620 helps to propel the aggregate underneath the drums 660, 600 and towards the conveyor 220 for removal.

Figure 7A:
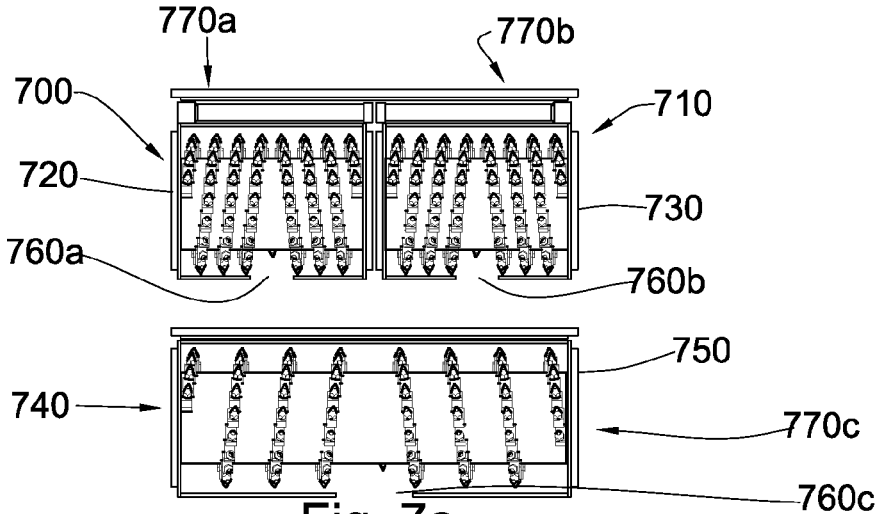
FIG. 7*a* is a diagram of an another embodiment of rotary degradation drums.
Figure 7B:
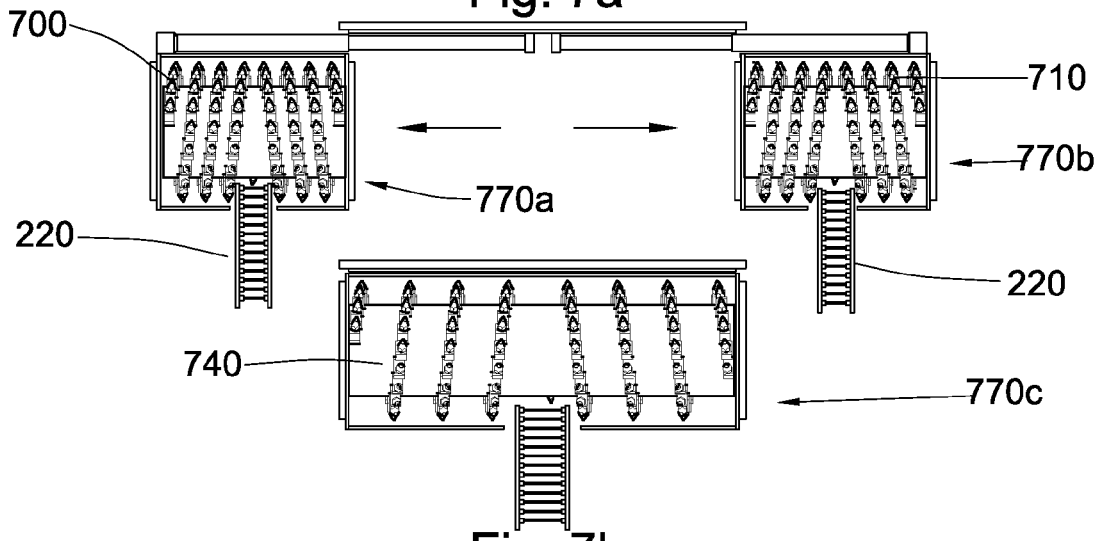
FIG. 7*b* is a diagram of an another embodiment of rotary degradation drums.

FIG. 7*a* discloses an embodiment of rotary degradation drums 700, 710, 740. Rotary degradation drum 700 is configured to extend in an opposing direction from the direction rotary degradation drum 710 is configured to extend. Additionally, rotary degradation drums 700 and 730 are contained on separate axles. Degradation drum 740 is supported by a separate axle 750. The rotary degradation drums 700, 710, 740 are each encased in separate milling chambers 770*a*, 770*b* and 770*c*. On the forward end of each of the milling chambers 770*a*, 770*b* and 770*c* are openings 760*a*, 760*b* and 760*c* for conveyor belts to enter inside. FIG. 7*b* discloses another embodiment of the same set of rotary degradation drums 700, 710, 740 as FIG. 7*a*, except that drums 700 and 710 are extended outward. A hydraulic mechanism may cause this translation to occur. A sliding roller mechanism may also facilitate such a translation. FIG. 7*b* discloses an extended width of the rotary degradation drums 700, 710, 740 that may be beyond the milling machine's 100 width. FIG. 7*b* also discloses individual conveyor belts 220 entering the openings of the milling chambers 770*a*, 770*b* and 770*c*.

Figure 7C:
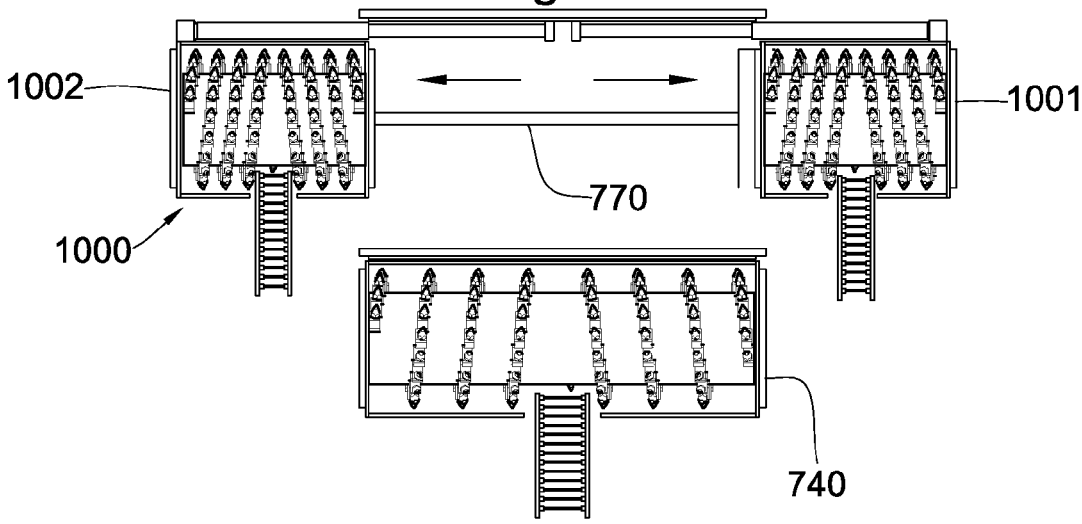
FIG. 7*c* is a diagram of an another embodiment of rotary degradation drums.

FIG. 7*c* discloses a split rotary degradation drum 1000 supported by a common axle. The split drum 1000 has two portions 1001, 1002, which rotate together by the common axle 770.

Figure 8:
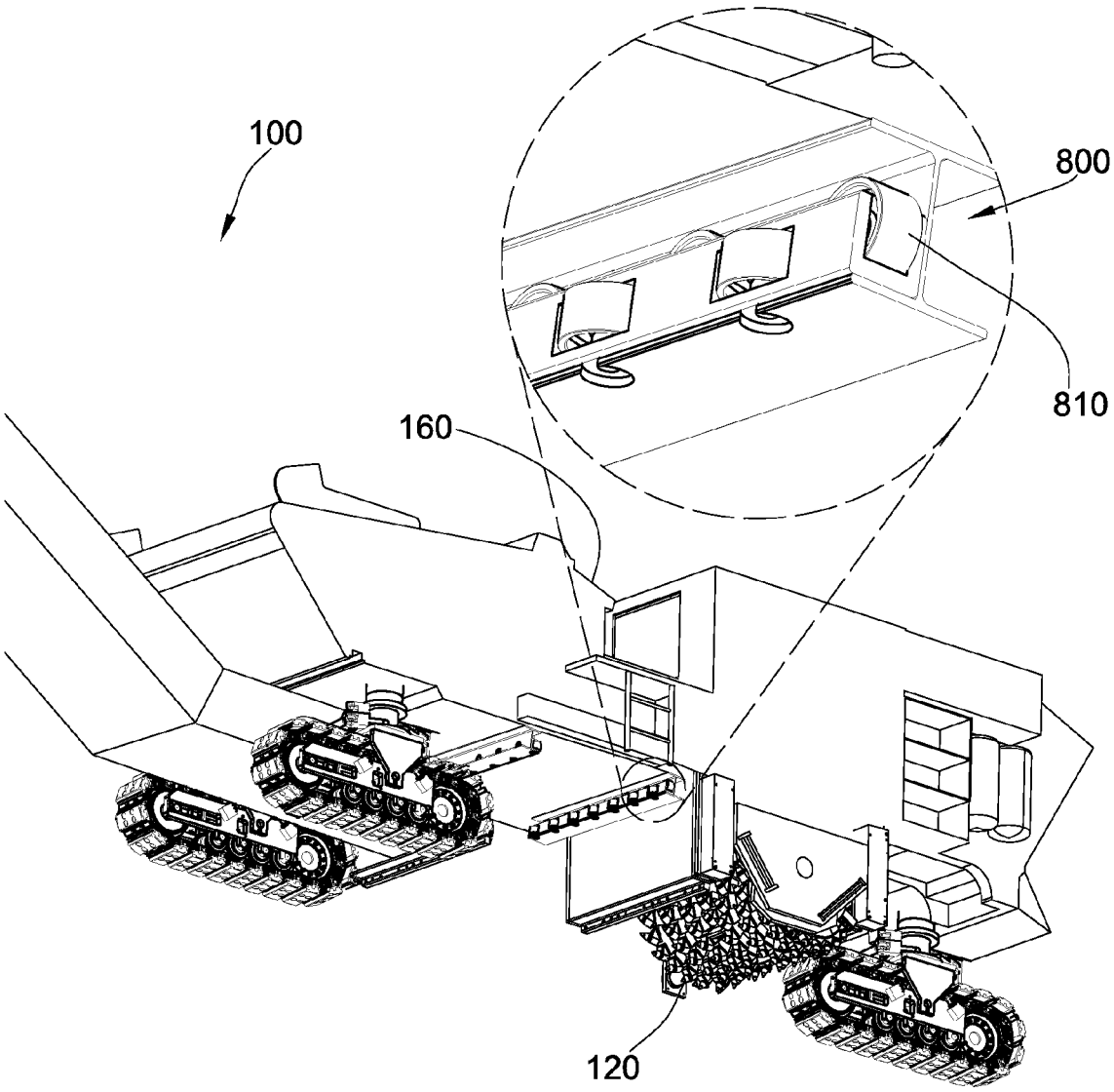
FIG. 8 is a perspective diagram of an another embodiment of a milling machine.

FIG. 8 discloses a track mechanism 800 secured to the underside of the machine that accommodates the lateral movement of the rotary degradation drums. A plurality of rollers may be disposed within the track mechanism. At least one roller may be passive, such that the roller reduces friction as the drum and/or milling chamber moves. In some embodiments, at least one roller is active, where a controller 160 causes the roller 810 to move with sufficient force to push the rotary degradation drums 120 inward or outward.

Figure 9:
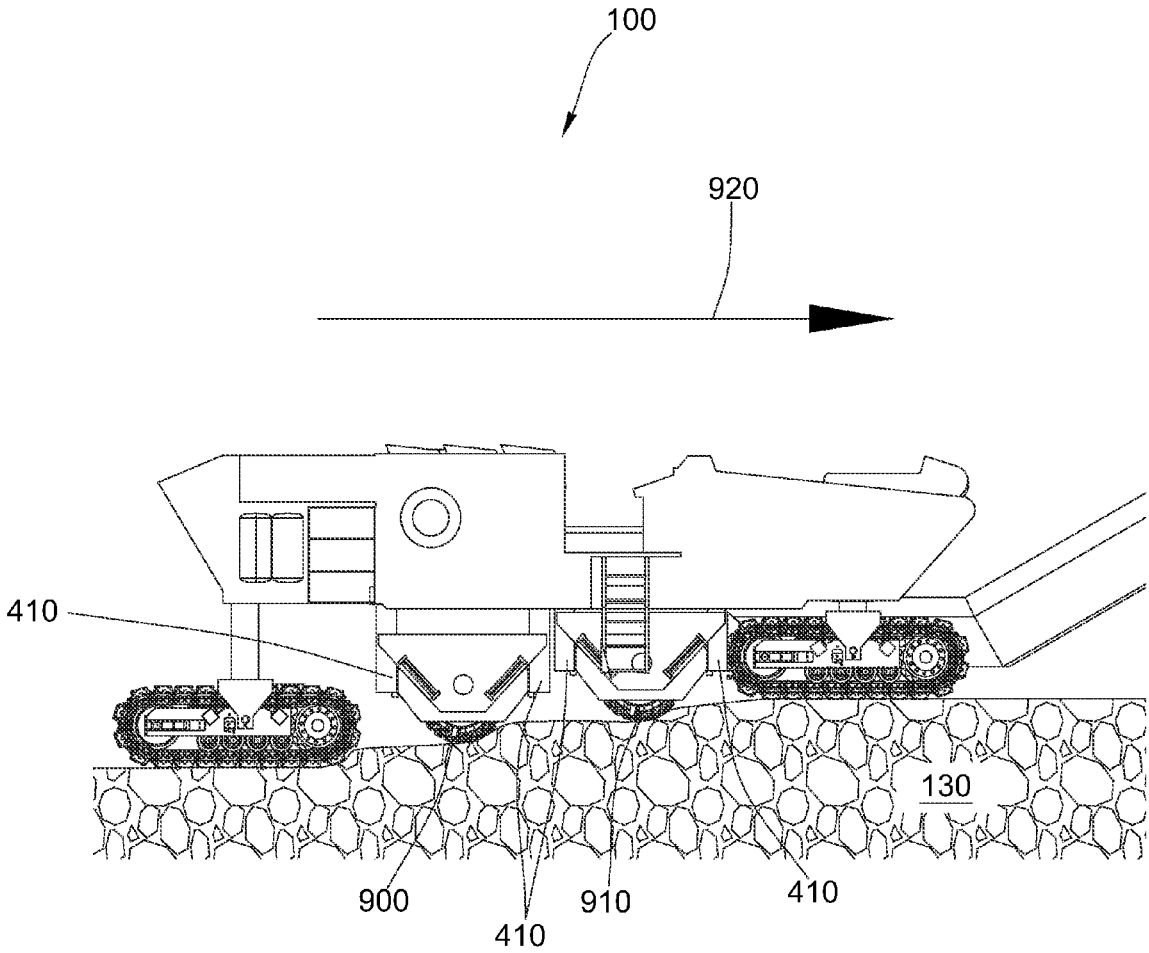
FIG. 9 is an orthogonal diagram of an another embodiment of a milling machine.

FIG. 9 discloses a milling machine 100 that travels in the direction as indicated by the arrow 920. A rearward rotary degradation drum 900 is positioned at a lower altitude than a forward rotary degradation drum 910 by means of hydraulic ram mechanisms 410. Thus, the depth of cut is sequentially increased as the machine passes over the paved surface. Excessive drum strain and wear, which is commonly associated with prior art machines that engage in deep cuts, is avoided. Instead, the forward rotary degradation drum 910 makes the first cut into the formation 130 at a reasonable depth and the rearward rotary degradation drum 900 makes a second, deeper cut into the formation 130. The hydraulic ram mechanisms 410 may move independently of one another such that the forward and rearward rotary degradation drums 910, 900 may be positioned in a diagonal direction relative to the milling machine, such that a drum is angled side to side, or in a pivotal direction relative to the milling machine, such that a drum is angled front to back.

What is claimed is:

1. A motorized vehicle, comprising:

a vehicle frame comprising translatable elements;

the frame comprises a forward end and rearward end;

a first rotary degradation drum connected to an underside of the frame;

at least a second rotary degradation drum also connected to the underside of the frame and rearward of the first rotary degradation drum; and at least one of the first and second rotary degradation drums is in communication with an actuating mechanism adapted to move the rotary degradation drum in a horizontal, vertical, transverse, diagonal, and pivotal direction relative to the motorized vehicle.

2. The vehicle of claim 1, wherein at least one of the first and second rotary degradation drums are configured to translate laterally with respect to a length of the frame.

3. The vehicle of claim 1, wherein the first and second rotary degradation drums are configured to degrade a formation at different depths.

4. The vehicle of claim 1, wherein the first and second rotary degradation drums are capable of expanding outwards such that collectively they mill a path wider than the milling machine.

5. The vehicle of claim 1, wherein at least one of the first and second rotary degradation drums comprises a plurality of cutting elements enhanced with polycrystalline diamond.

6. The vehicle of claim 1, wherein a degradation zone in a direction of travel occurs about the rotary axis which is perpendicular to the underside of the motorized vehicle.

7. The vehicle of claim 1, wherein the first rotary degradation drum and the second rotary degradation drum are configured to degrade a formation into aggregate.

8. The vehicle of claim 1, wherein a conveyor belt is attached to a milling chamber.

9. The vehicle of claim 8, wherein a conveyor belt is encased by a chute with open ends.

10. The vehicle of claim 1, wherein liquid jets are attached to the underside of the vehicle to remove aggregate from the rotary degradation drums.

11. The vehicle of claim 1, wherein a hydraulic mechanism is configured to translate at least one of the first and second rotary degradation drums.

12. The vehicle of claim 1, wherein the first and second rotary degradation drums are configured to translate laterally along a track attached to the underside.

13. The vehicle of claim 1, wherein the first and second rotary degradation drums are configured to operate simultaneously.

14. The vehicle of claim 1, wherein the first rotary degradation drum and the second rotary degradation drum are encased in separate milling chambers.

15. The vehicle of claim 1, wherein the first and second rotary degradation drums are encased in the same milling chamber.

16. The vehicle of claim 1, wherein the second rotary degradation drum is a split drum with a single axle.

17. The vehicle of claim 16, wherein a milling chamber housing the split drum is expandable.

18. The vehicle of claim 17, wherein the split rotary degradation drum comprises portions that are configured to extend beyond a side of the motorized vehicle.

19. The vehicle of claim 1, wherein the second rotary degradation drum is positioned laterally to a third independent rotary degradation drum.

* * * * *